US010648723B2

(12) United States Patent
Cho et al.

(10) Patent No.: US 10,648,723 B2
(45) Date of Patent: May 12, 2020

(54) REFRIGERATOR

(71) Applicant: LG ELECTRONICS INC., Seoul (KR)

(72) Inventors: Yonghyeon Cho, Seoul (KR); Sunghee Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 389 days.

(21) Appl. No.: 15/381,400

(22) Filed: Dec. 16, 2016

(65) Prior Publication Data

US 2017/0261250 A1 Sep. 14, 2017

(30) Foreign Application Priority Data

Mar. 9, 2016 (KR) ..... 10-2016-0028175

(51) Int. Cl.
*F25D 17/06* (2006.01)
*F25D 11/00* (2006.01)
(Continued)

(52) U.S. Cl.
CPC ..... *F25D 17/062* (2013.01); *F25D 11/00* (2013.01); *F25D 17/065* (2013.01); *F25D 23/02* (2013.01);
(Continued)

(58) Field of Classification Search
CPC ..... F25D 17/062; F25D 2317/0671
(Continued)

(56) References Cited

U.S. PATENT DOCUMENTS 2,226,395 A * 12/1940 Tanner ..... F25D 17/062 62/418
5,209,082 A * 5/1993 Ha ..... F25D 23/025 312/236
(Continued)

FOREIGN PATENT DOCUMENTS

CN 1186211 7/1998
CN 103629880 3/2014
(Continued)

OTHER PUBLICATIONS

Ohira et al., KR20140026244 English machine translation, Mar. 5, 2014 (Year: 2014).*
(Continued)

*Primary Examiner* — Grant Moubry
*Assistant Examiner* — Phillip Decker
(74) *Attorney, Agent, or Firm* — KED & Associates, LLP

(57) ABSTRACT

A refrigerator comprising a cabinet comprising a storage compartment provided therein; a first door rotatably coupled to the cabinet to open and close the storage compartment; an outer door rotatable opening and closing an opening that is provided in the inner door; and a multi-duct provided in an inner wall of the storage compartment and comprising: a first duct comprising a first upper outlet hole a first middle outlet hole and a first lower outlet hole for exhausting cold air toward the first door of the storage compartment; and a second duct comprising a second upper outlet hole, a second middle outlet hole and a second lower outlet hole for exhausting cold air toward the inner door of the storage compartment, wherein an inlet hole for sucking cold air to the first duct is smaller than an inlet hole for sucking cold air to the second duct.

20 Claims, 14 Drawing Sheets

(51) Int. Cl.
*F25D 23/02* (2006.01)
*F25D 23/04* (2006.01)

(52) U.S. Cl.
CPC ..... *F25D 23/04* (2013.01); *F25D 2317/0661* (2013.01); *F25D 2317/0671* (2013.01); *F25D 2323/021* (2013.01); *F25D 2323/023* (2013.01)

(58) Field of Classification Search
USPC ..... 454/183; 62/404
See application file for complete search history.

(56) References Cited

U.S. PATENT DOCUMENTS

| | | | | |
|---|---|---|---|---|
| 5,979,174 | A * | 11/1999 | Kim | F25D 17/065 62/404 |
| 6,070,419 | A * | 6/2000 | Chang | F24F 9/00 62/408 |
| 6,347,530 | B1 | 2/2002 | Kim | |
| 8,397,533 | B2 * | 3/2013 | Lee | F25D 17/065 62/420 |
| 2012/0096872 | A1 | 4/2012 | Cheong et al. | |
| 2013/0000333 | A1 * | 1/2013 | Kim | F25D 17/065 62/129 |
| 2014/0232250 | A1 | 8/2014 | Kim et al. | |
| 2016/0138849 | A1 * | 5/2016 | Lee | F25D 17/06 62/186 |
| 2016/0223244 | A1 * | 8/2016 | Wait | F25D 17/062 |
| 2017/0314842 | A1 * | 11/2017 | Lee | F25D 17/062 |
| 2019/0056165 | A1 * | 2/2019 | Im | F25D 23/04 |

FOREIGN PATENT DOCUMENTS

| | | | | |
|---|---|---|---|---|
| CN | 105074368 | | 11/2015 | |
| JP | H 10-185406 | | 7/1998 | |
| JP | 2002098462 | A * | 4/2002 | |
| KR | 10-0160419 | | 1/1999 | |
| KR | 10-0164954 | | 2/1999 | |
| KR | 10-2007-0059507 | | 6/2007 | |
| KR | 10-2014-0026244 | | 3/2014 | |
| WO | WO 2006/083111 | | 8/2006 | |
| WO | WO 2014/198152 | | 12/2014 | |
| WO | WO-2015043646 | A1 * | 4/2015 | F25D 17/062 |

OTHER PUBLICATIONS

European Patent Office dated Apr. 3, 2018 issued in application No. 17152045.5.
European Search Report dated May 9, 2017 issued in Application No. 17 15 2045.5.
Samsung RF31FMESBSR 31 cu. 4-Door Refrigerator Review YouTube video uploaded Jun. 25, 2014.
Chinese Office Action issued in application No. 201710025930.6 dated Feb. 1, 2019 with English Translation.
Chinese Office Action (with English translation) dated Aug. 15, 2019 issued in CN Application No. 201710025930.6.

* cited by examiner

REFRIGERATOR

CROSS-REFERENCE TO RELATED APPLICATION(S)

Pursuant to 35 U.S.C. § 119(a), this application claims the benefit of earlier filing date and right of priority to Korean Application No. 10-2016-0028175, filed on Mar. 9, 2016, the contents of which are hereby incorporated by reference herein in their entirety.

BACKGROUND

1. Field

The present disclosure relates to a refrigerator, and more particularly, to a refrigerator in which a preset constant temperature may be uniformly distributed.

2. Background

Generally, a refrigerator may include a mechanical chamber that is provided in a lower portion of a cabinet. Such a mechanical chamber is typically installed in the lower portion for the center of the gravity, assembling efficiency and vibration reduction in the refrigerator.

A freeze cycle mechanism may be installed in the mechanism chamber of the refrigerator. The freezer cycle mechanism may keep internal spaces of the refrigerator in a freezing or refrigerating state so as to preserve and store food fresh by using the characteristic of refrigerant that absorbs external heat while getting converted into a gaseous refrigerant from a low-pressure liquid refrigerant.

The freezer cycle mechanism provided in the refrigerator may include a compressor for converting a low-temperature-low-pressure gaseous refrigerant into a high-temperature-and-high-pressure gaseous refrigerant; a condenser for converting the high-temperature-and-high-pressure gaseous refrigerant into a high-temperature-and-high-pressure liquid refrigerant; and an evaporator for absorbing external heat while converting the low-temperature-and-high-pressure liquid refrigerant heat-changed in the condenser into gaseous refrigerant.

A refrigerator that has been released recently includes an ice-maker installed in a refrigerator door to provide a user with ice conveniently. Such a refrigerator may include two doors to define an auxiliary storage space in the door arranged in an internal space. However, this conventional refrigerator needs to have an improved cold air supply method so as to supply cold air to the overall storage space efficiently and uniformly.

Generally, a food storage space may be defined in a conventional refrigerator by a cabinet and a door that are filled with insulating material and the food storage space may be capable of shutting out the heat penetrating from the outside. The refrigerator may include a freeze mechanism that consists of an evaporator absorbing internal heat of the food storage space; and a heat radiation device exhausting the heat collected from the food storage space outside, so as to keep the food storage space at a preset temperature which makes it difficult for micro-organisms to live or proliferate in the food storage space and preserve food stuffs for a relatively long time without spoiling.

The refrigerator may include one or more refrigerator compartments for storing food stuffs at temperatures above freezing; and one or more freezer compartments for storing food stuffs at temperatures below zero that is a freezing point. Based on the arrangement of the freezer and refrigerator compartments, the refrigerator may be classified into a top freezer type refrigerator having a top freezer compartment and a bottom refrigerator compartment; a bottom freezer type refrigerator having a bottom freezer compartment and a top refrigerator compartment; and a side-by-side type refrigerator having a left freezer compartment and a right refrigerator compartment. A plurality of storage racks or drawers may be provided in the food storage space to allow a user to put or take out food stuffs in or from the food storage space.

BRIEF DESCRIPTION OF THE DRAWINGS

Embodiments will be described in detail with reference to the following drawings in which like reference numerals refer to like elements, and wherein.

DETAILED DESCRIPTION

Figure 1:
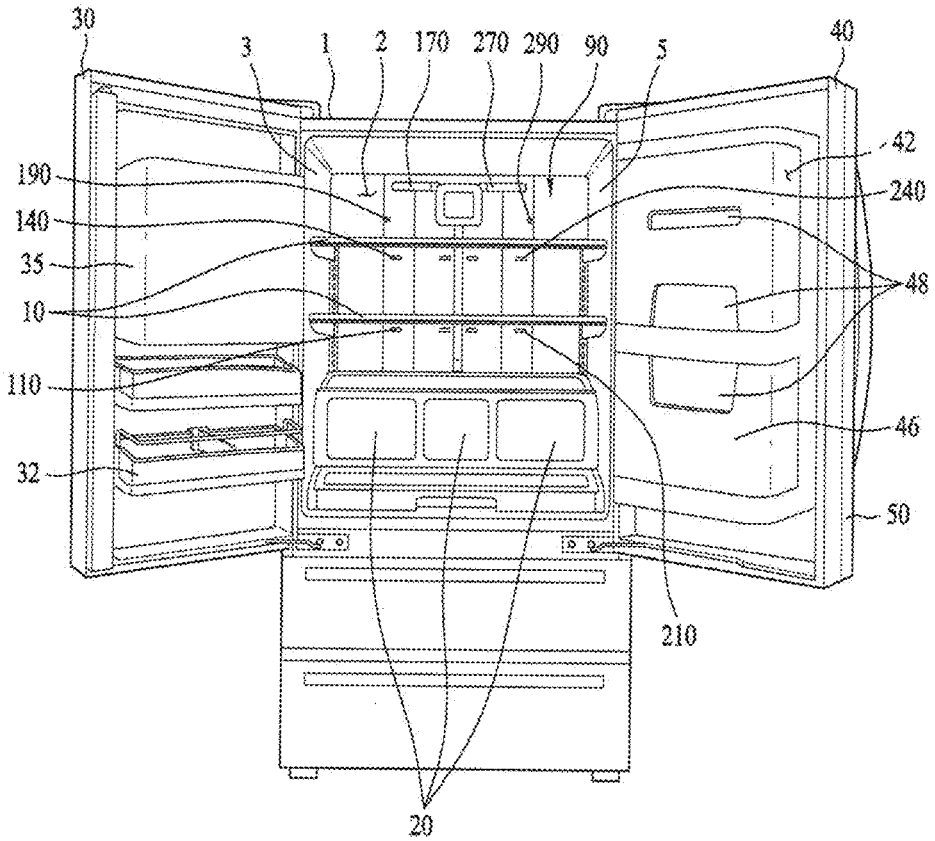
FIG. 1 is a front view of a refrigerator in accordance with one embodiment.

Referring to FIG. 1, the refrigerator in accordance with one embodiment may include a cabinet 1. The cabinet 1 may include a storage compartment 2 for storing food stuffs. The storage compartment 2 may have a left wall 3 and a right wall 5 as well as a top and a bottom, so as to define a predetermined space separated from the outside.

A plurality of racks 10 may be arranged in the storage compartment 2 for diverse food stuffs with various heights to be stored therein. In this instance, the racks 10 may be extended enough to connect the left wall 3 and the right wall 5 with each other. The storage compartment 2 may have the left wall 3 and the right wall 5, so that the user can store or keep food in the space defined by the left and right walls 3 and 5.

The storage compartment 2 may include a drawer 20 to keep the food stuffs in the internal space of the storage compartment 2 airtight. A plurality of drawers 20 may be provided and various kinds of foods may be categorized to be stored in the drawers, respectively. The drawer 20 may be retractable or movable forward or backward, so that the user can move the drawer 20 after putting or taking some food stuffs in or out of the drawer 20.

A first door 30 may be provided on a predetermined side of the storage compartment 2 and may rotate to open and close the storage compartment 2. The first door 30 may be rotatably coupled to one side of the cabinet 1 to open and close the entire storage compartment 2 or just a left portion of the storage compartment 2.

An ice-maker 35 may be provided in the first door 30 to provide a user with ice. The user may operate the ice-maker 35 and discharge ice from the ice-maker 35 even in a state where the first door 30 has closed the storage compartment 2.

The storage compartment 2 may be a refrigerator compartment for storing foods at temperatures above zero. The ice-maker 35 may be kept at preset temperatures below zero to provide the user with ice. The storage compartment 2 may include an auxiliary duct to supply the cold air with a temperature below zero to the ice-maker 35 so that the temperature of the ice-maker 35 may fall down to a lower temperature than the storage compartment 2. The ice-maker 35 may have a communication opening provided in or at a front surface of the first door 30 and the user may be provided with the ice through the communication opening.

A rack 32 for storing foods may be provided in or at the first door 30 to allow the user to store food stuffs. The rack 32 may have a predeterminedly high wall formed at a rear side to prevent the food stuffs from falling therefrom.

An inner door 40 may be provided at the other end of the storage compartment 2 and may rotate to open and close the other portion of the storage compartment 2. An outer door 50 may be provided in a front surface of the inner door 40 to open and close an opening formed in the inner door 40.

The inner door 40 and the outer door 50 may be rotatably coupled to the cabinet 1 in an independent way. The user may be able to open and close the other portion of the storage compartment 2 by rotating the inner and outer doors 40 and 50 together. The user may also be able to open and close a front surface of the inner door 40 by rotating the outer door 50 in a state of closing the other portion of the storage compartment 2. A handle may be provided at a front side of the outer door 50 and the user may rotate the outer door 50 by grabbing the handle.

The inner door 40 may include a predetermined storage space 42 in which food stuffs are stored. The storage space 42 may be another space that is separated from the outer door 50 and not installed in the outer door 50. An opening may be provided in the storage space 42 and may be opened and closed by the outer door 50. The user may have access to the storage space 42 via the opening and then use the storage space 42.

A plurality of racks may be provided in the storage space 42 so that the user can store diverse food stuffs with different heights in the storage space 42. A cover 46 may be provided on a rear surface of the storage space 42 so as to partially close the storage space 42 from the storage compartment 2. A plurality of penetrating holes 48 may be provided in the cover 46 to allow cold air to be sucked into the storage space 42 from the storage compartment 2. Air may be able to flow from the storage compartment 2 to the storage space 42 and vice versa.

A multi-duct 90 may be provided at the rear surface of the storage compartment 2 to supply cold air to the storage compartment 2. The multi-duct 90 may have a plurality of outlet holes to supply cold air to the storage compartment 2 and the cold air may be supplied to diverse locations in the storage compartment 2 via the outlet holes.

The multi-duct 90 may include a first upper outlet hole 170, a first middle outlet hole 140 and a first lower outlet hole 110 to exhaust cold air toward the first door 30; and a second upper outlet hole 270, a second middle outlet hole 240 and a second lower outlet hole 210 to exhaust cold air toward the inner door 40. The multi-duct 90 may also include a first outlet hole 190 formed between the first upper outlet hole 170 and the first middle outlet hole 140, and a second outlet hole 290 formed between the second upper outlet hole 270 and the second middle outlet hole 240.

The first outlet hole 190 may be arranged closer to the left wall 3 of the storage compartment 2 than the first upper outlet hole 170 and the first middle outlet hole 140. Accordingly, the first outlet hole 190 may be different from the first upper and middle outlet holes 170 and 140 in height and right-and-left position so as to supply cold air to two diverse locations in the storage compartment 2.

The second outlet hole 290 may be arranged closer to the right wall 5 of the storage compartment 2 than the second upper outlet hole 270 and the second middle outlet hole 240. Accordingly, the second outlet hole 290 may be different from the second upper outlet hole 270 and the second middle outlet hole 240 in height and right-and-left location so as to supply cold air to the diverse locations in the storage compartment 2.

The first upper outlet hole 170 and the first middle outlet hole 140 may be arranged side by side with respect to the racks 10. The first middle outlet hole 140 and the first lower outlet hole 110 may be arranged side by side with respect to the racks 10, with different heights. Accordingly, the first upper outlet hole 170 may be able to chill an upper space of one uppermost rack 10 and the first middle outlet hole 140 may be able to chill a certain space between two racks 10. The first lower outlet hole 110 may be able to chill a lower space of one lowermost rack 10.

The second upper outlet hole 270 and the second middle outlet hole 240 may be arranged side by side with respect to the racks 10. The second middle outlet hole 240 and the second lower outlet hole 210 may be arranged side by side with respect to the racks 10, with different heights. Accordingly, the second upper outlet hole 270 may be able to chill an upper space of the uppermost rack 10 and the second middle outlet hole 240 may be able to chill a space between two racks 10. The second lower outlet hole 210 may be able to chill a lower space of the lowermost rack 10. The storage compartment 2 may form one chamber but it may be likely to have high resistance against air flow because of the racks 10, the drawers 20 and the foods stored in corresponding sections.

Figure 2:
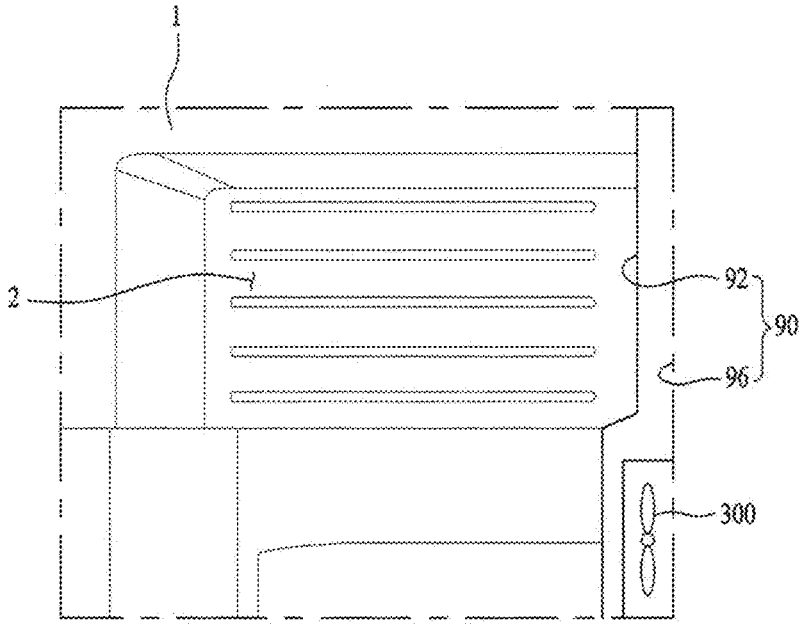
FIG. 2 is a diagram schematically illustrating a multi-duct provided in the refrigerator.

With reference to FIG. 2, the multi-duct 90 may include a multi-duct cover 92 exposed to the storage compartment 2, and an heat-insulation material 96 covering a rear side of the multi-duct cover 92. The multi-duct 90 may supply the cold air passing the space formed between the multi-duct cover 92 and the heat-insulation material 96 to the storage compartment 2.

A fan 300 may be provided in a lower portion of the multi-duct 90. When the fan 300 is rotated, upward air flow may be generated. Once the fan 300 is put into operation, the internal air of the multi-duct 90 may be exhausted to the storage compartment 2 via the outlet holes. The fan 300 may be Sirocco fan. When the fan 300 is rotated, the air chilled by heat-exchange with the evaporator may be sucked into the multi-duct 90 and flow into the storage compartment 2.

Figure 3:
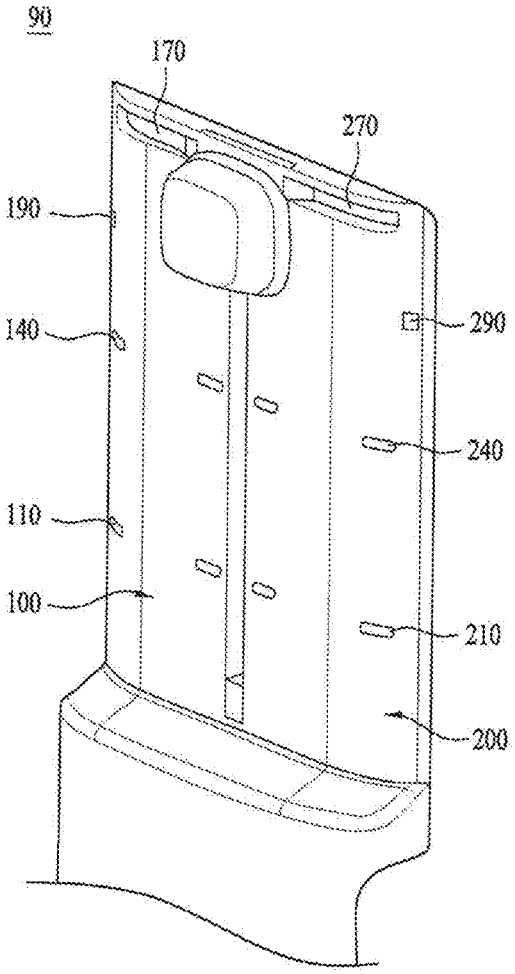
FIG. 3 is a diagram illustrating a front surface of the multi-duct in accordance with one embodiment.
Figure 4:
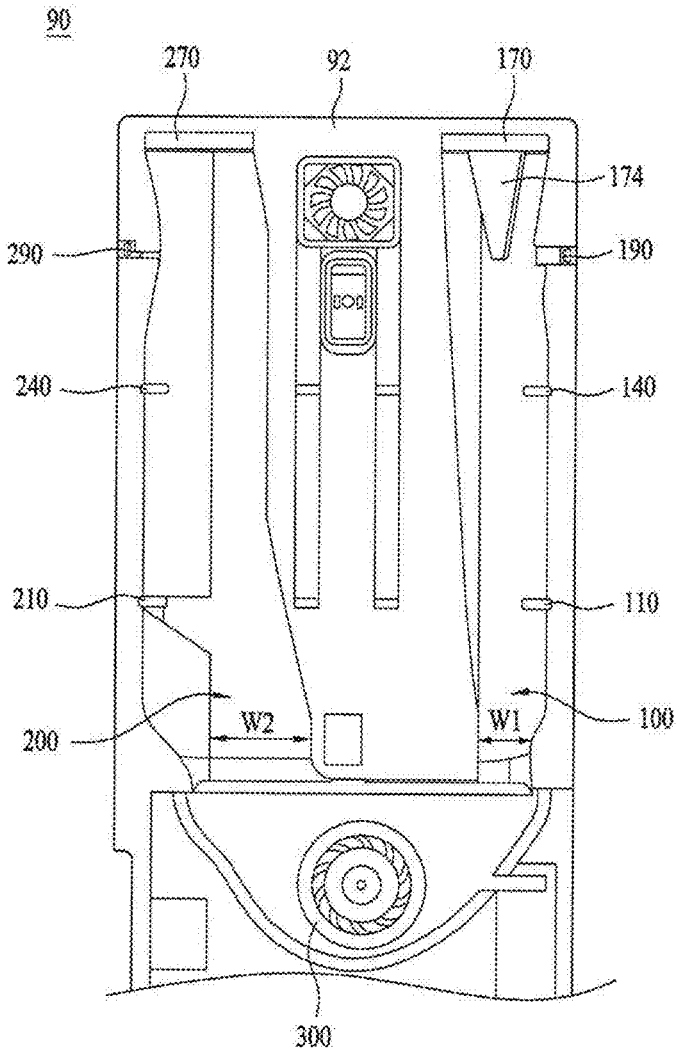
FIG. 4 is a diagram illustrating a rear surface of the multi-duct in accordance with one embodiment.

As shown in FIGS. 3 and 4, the first duct 100 may be provided at a left side and the second duct 200 may be provided at a right side, when viewed from the front. The cold air exhausted from the first duct 100 may flow toward the first door 30 and the cold air exhausted from the second duct 200 flow toward the inner door 40.

Once the fan 300 is driven in the multi-duct 90, air may start to flow upward and may be guided to each of the outlet holes. Lower portions of the first and second ducts 100 and 200 of the multi-duct 90 may be used as inlets of the air flowing to the multi-duct 90.

As mentioned above, the ice-maker 35 of which the temperature is kept lower than the temperature of the refrigerator may be provided in the first door 30. The temperature of the portion near the first door 30 may happen to become lower because of cold air leakage from the ice-maker 35, heat radiation, conduction, or convection.

Accordingly, in the illustrated embodiment, the inlet for sucking cold air to the first duct 100 may be formed smaller than the inlet for sucking cold air to the second duct 200, so as to supply more cold air to the second duct 200 than the first duct 100. In other words, the width (W1) of the inlet formed in the first duct 100 may be smaller than the width (W2) of the inlet formed in the second duct 200 so as to supply more cold air to the second duct 200 from the multi-duct 90. Approximately, the ratio of the air supplied to the first duct 100 to the second duct 200 may be 2:3.

The amount of the cold air supplied to the left side of the storage compartment 2 may be different from that of the cold air supplied to the right side, only to make the temperatures inside the storage compartment 2 uniformly distributed. The cold air chilled while the fan 300 is being rotated in a clockwise direction may flow to upper portions of the first and second ducts 100 and 200.

The upper width of the first duct 100 may be broader than the lower width, so that air resistance may be reduced in the first duct 100. Specifically, the space of the duct where air flows may become broader than the inlet of the first duct 100 and air may flow smoothly in the duct, even though the inlet amount of air is reduced.

The surface of the multi-duct which is exposed to the storage compartment 2 may become inclined downward from the center as coming right and left sides. In other words, the multi-duct cover 92 may bulge toward the center to have an overall three-dimensional shape.

Figure 5A:
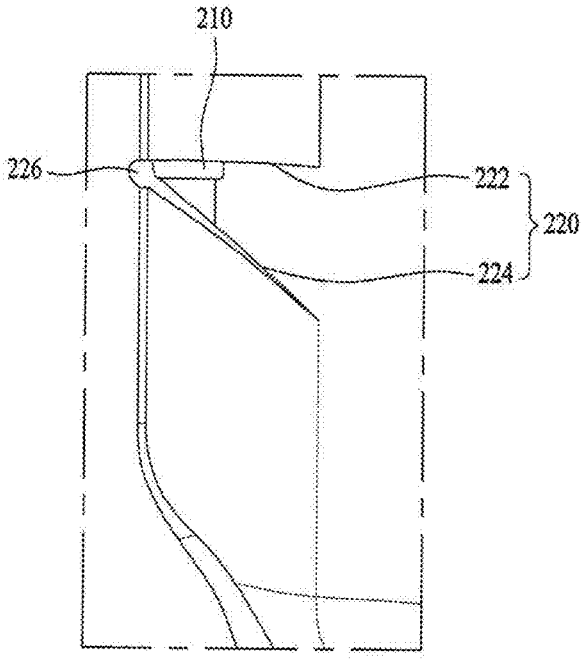
FIG. 5A is a diagram illustrating a second lower outlet hole.
Figure 5B:
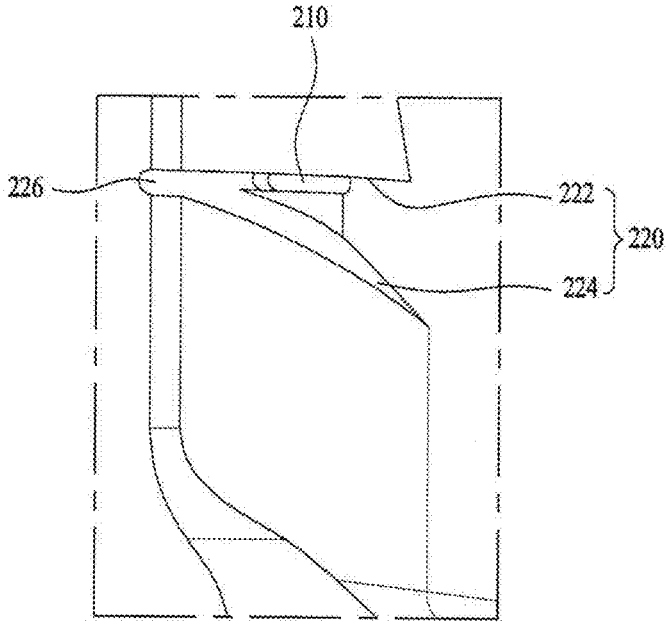
FIG. 5B is another diagram illustrating a second lower outlet hole.
Figure 5C:
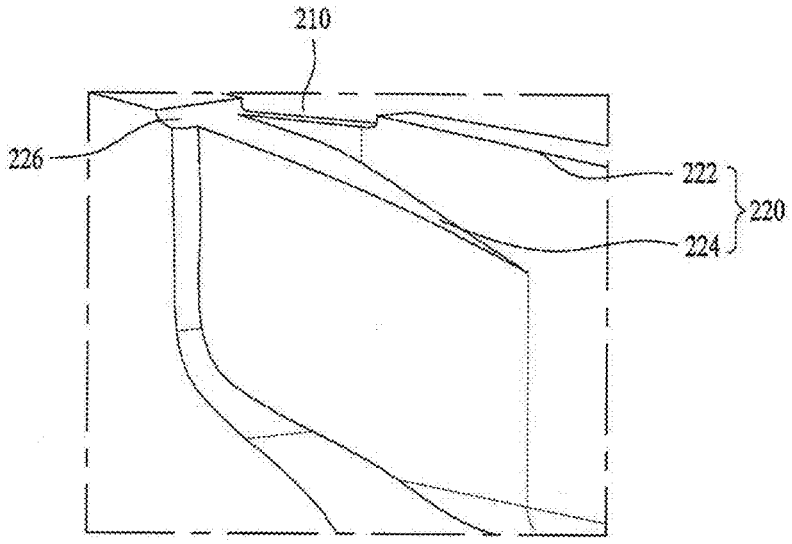
FIG. 5C is yet another diagram illustrating a second lower outlet hole.

As shown in FIGS. 5A-5C, the second duct 200 may include a guide portion 220 to guide cold air toward the second lower outlet hole 210. The guide portion 220 may include an upper surface 222 and a lower surface 224. The gap between the upper surface 222 and the lower surface 224 may become narrower toward the second lower outlet hole 210. The guide portion 220 may guide the air flow so as to increase the velocity of air flow when the air supplied to the second duct 200 is supplied to the second lower outlet hole 210.

One end of the guide portion 220 may have an extension 226 that extends backward from one end of the second lower outlet hole 210, and one end of the extension 226 may be rounded. Accordingly, the air flowing along the guide portion 220 may hit the extension 226 and get exhausted via the second lower outlet hole 210. The extension 226 may have a curved surface to reduce the resistance of the air exhausted via the second lower outlet hole 210.

The extension 226 may be arranged closer to the right wall 5 of the storage compartment 2 than the other end of the guide portion 220. Accordingly, even the air that flows rightward from the second duct 200 may be guided by the extension 226 to be exhausted to the storage compartment 2.

The distance between the upper surface 222 and the lower surface 224 at the other end of the guide portion 220 may be larger than the distance between them in a longitudinal direction of the second lower outlet hole 210. The upper surface 222 may be horizontally extended to become parallel with an upper end of the second lower outlet hole 210 and the lower surface 224 may be inclinedly extended to become far from the upper surface 222, forming a triangle shape.

In other words, a cross section area of the inlet for sucking air into the guide portion 220 may be broader than a cross section area of the air that flows to the other end of the guide portion, so as to increase the velocity of the air exhausted via the second lower outlet hole 210.

The other end of the guide portion 220 may be extended to become closer to the center of the multi-duct 90 than the second lower outlet hole 210. The air that flows in the second duct 200 may be exhausted via the second lower outlet hole 210 along the guide of the guide portion 220.

The upper surface 222 of the guide portion 220 may be adjacent to a top of the second lower outlet hole 210 and stepped downward. As air rises in the second duct 200, the air moving upward may collide with the upper surface 222 and then may be exhausted via the second lower outlet hole 210.

The guide portion 220 may become thicker in a back-and-forth direction, when approaching the right wall 5 of the storage compartment 2. As the multi-duct cover 92 has a convex center, the back-and-forth direction thickness of the guide portion 220 may have to be secured so as to reduce the resistance of the air exhausted via the second lower outlet hole 210.

Figure 6:
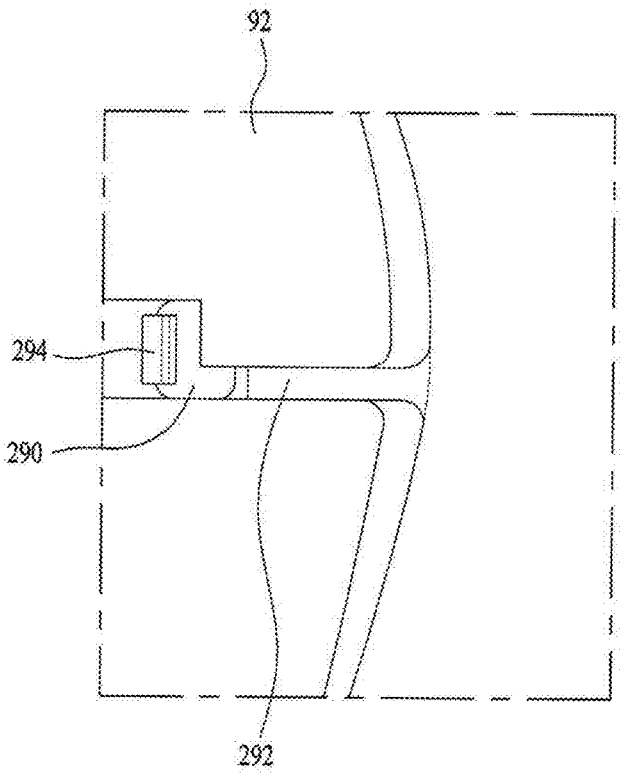
FIGS. 6 and 7 are diagrams illustrating a second outlet hole.
Figure 7:
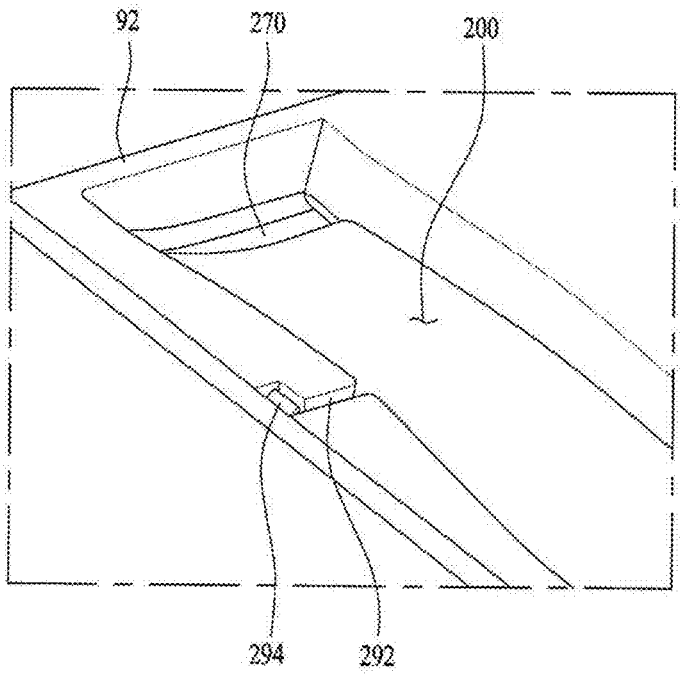

As seen in FIGS. 6 and 7, the second outlet hole 290 provided in the second duct 200 may exhaust cold air toward the second storage compartment 2. The location of the second outlet hole 290 may be different from locations of the other outlet holes provided in the second duct 200, so as to supply cold air to diverse locations inside the storage compartment 2.

The second duct 200 may further include a second guide groove 292 to guide air toward the second outlet hole 290. A second projected piece 294 may be provided at one end of the second outlet hole 290 to guide the exhaustion of the cold air via the second outlet hole 290.

After being branched by the second guide groove 292 or having the flow direction changed by the second projected piece 294, the air that flows inside the second duct 200 may be exhausted via the second outlet hole 290. The second outlet hole 290 may be located further to one side, compared with the other outlet holes formed in the second duct 200, so that the second guide groove 292 and the second projected piece 294 may move the air toward the second outlet hole 290.

The second guide groove 292 may be recessed in a back-and-forth direction, compared to the neighboring area. Accordingly, the top and bottom of the second guide groove 292 may be closed. In other words, the cold air in the second guide groove 292 may move only in the left direction when the fan 300 is put into operation. The second projected piece 294 may be provided at the end of the second outlet hole 290 so as to help the cold air to be exhausted via the second outlet hole 290 without passing by the second outlet hole 290.

Figure 8:
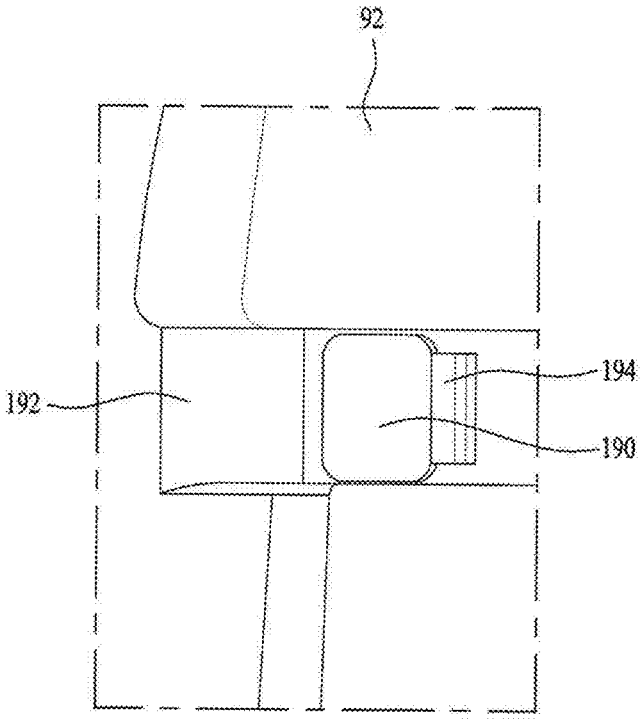
FIGS. 8 and 9 are diagrams illustrating a first outlet hole.
Figure 9:
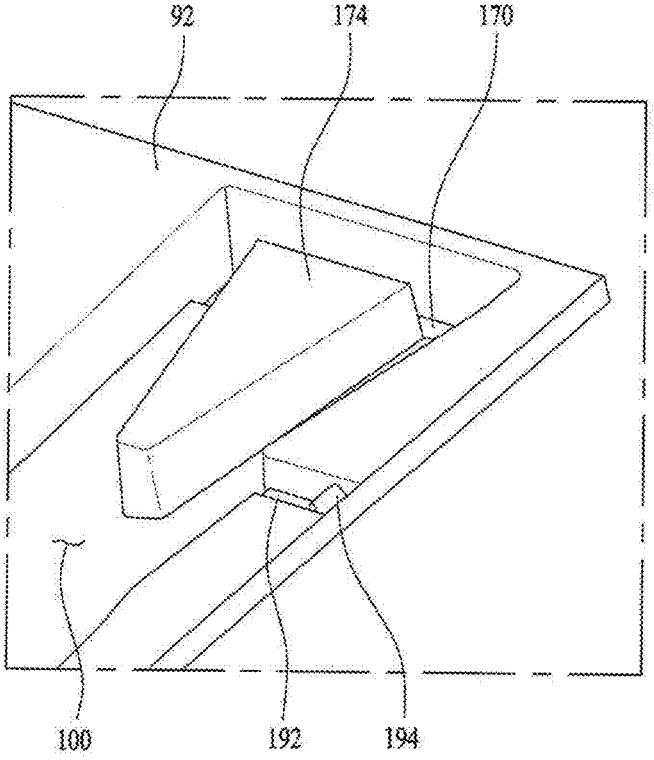

With reference to FIGS. 8 and 9, the first outlet hole 190 provided in the first duct 100 may exhaust cold air toward the storage compartment 2. The first outlet hole 190 may be different from the other outlet holes formed in the first duct 100 in height, so that the cold air may be supplied to diverse locations inside the storage compartment 2.

The first duct 100 may include a first guide groove 192 to guide air toward the first outlet hole 190. A first projected piece 194 may be provided at one end of the first outlet hole 190 to guide the exhaustion of the cold air via the first outlet hole 190.

After being branched by the first guide groove 192 or having the flow direction changed by the first projected piece 194, the air that flows inside the first duct 100 may be exhausted via the first outlet hole 190. The first outlet hole 190 may be located further to one side, compared with the other outlet holes formed in the first duct 100, so that the first guide groove 192 and the first projected piece 194 may move the air toward the first outlet hole 190.

The first guide groove 192 may be recessed in a back-and-forth direction, compared the neighboring area. Accordingly, the top and bottom of the first guide groove 192 may be closed. In other words, the cold air in the first guide groove 192 may move only in the right direction when the fan 300 is put into operation. The first projected piece 194 may be provided in the end of the first outlet hole 190 so as to help the cold air to be exhausted via the first outlet hole 190 without passing by the first outlet hole 190.

Figure 10:
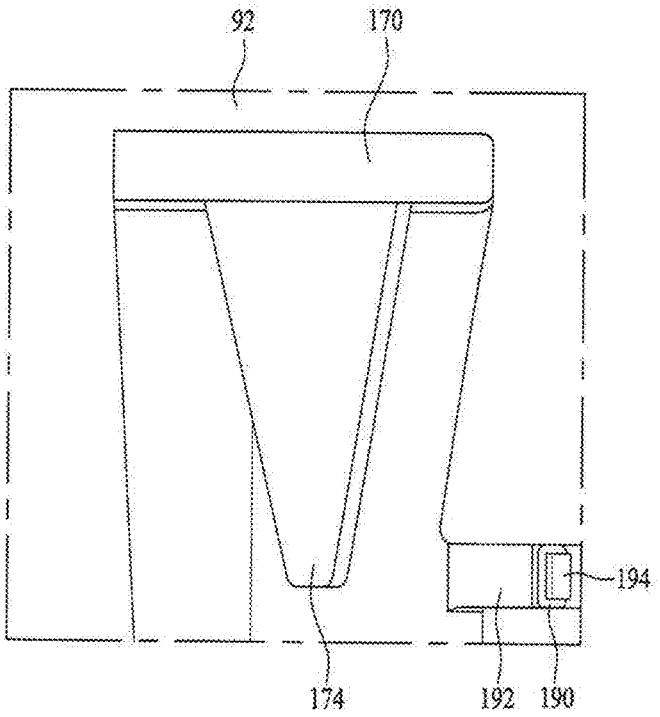
FIG. 10 is a diagram illustrating a first upper outlet hole.

With reference to FIG. 10, a projection 174 may be provided in the first duct 100 to reduce the amount of the cold air exhausted via the first upper outlet hole 170. The projection 174 may reduce the amount of the exhausted cold air by partially blocking the path of the air exhausted via the first upper outlet hole 170.

When the ice-maker 35 is provided in the first door 30, the temperature of the ice-maker 35 may be lower than that of the refrigerator compartment and thus it may be less necessary to chill the portion near the first door 30. If the same amount of cold air is supplied via the first upper outlet hole 170 as the amount of cold air supplied via the other outlet holes when the ice-maker 35 is arranged in an upper portion of the first door 30, the portion where the ice-maker 35 may be chilled at a lower temperature than the temperature at which the other portions are chilled. In this instance, the foods put in the locations corresponding to the heavily chilled portion may become chilled too much. To prevent that, the illustrated embodiment shows that the amount of the cold air supplied via the first upper outlet hole 170 may be reduced.

The projection 174 may have a width which gets broader from a lower end to an upper end. The upper end of the projection 174 may be smaller than the width of the first upper outlet hole 170, so that the first upper outlet hole 170 may be not completely closed by the projection 174.

The upper end of the projection 174 may be in contact with the first upper outlet hole 170. If rising higher than the projection 174, the internal air of the first duct 100 may pass the first upper outlet hole 170 and be supplied to the storage compartment 2.

Figure 11:
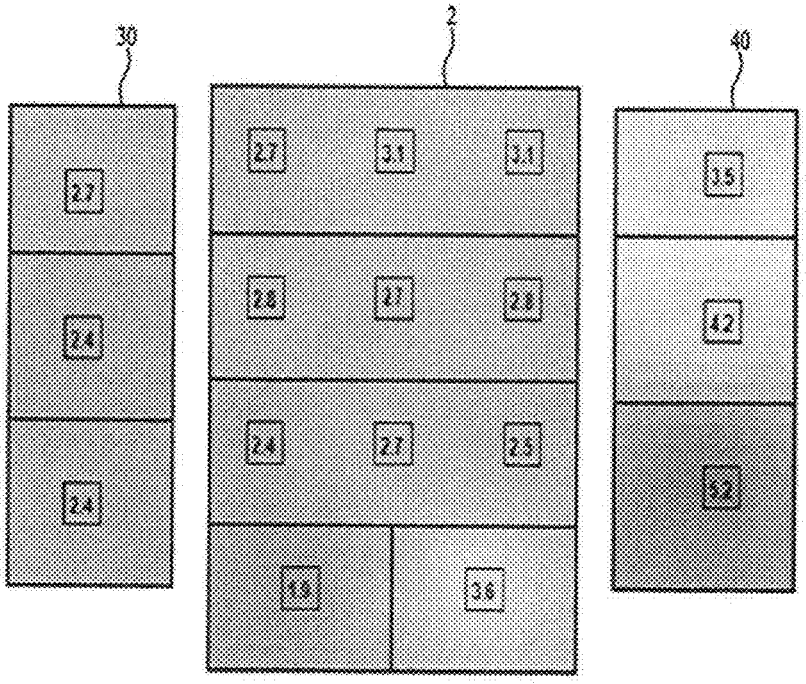
RELATED ART FIG. 11
FIG. 11 is a diagram illustrating temperature distribution in accordance of prior art.
Figure 12:
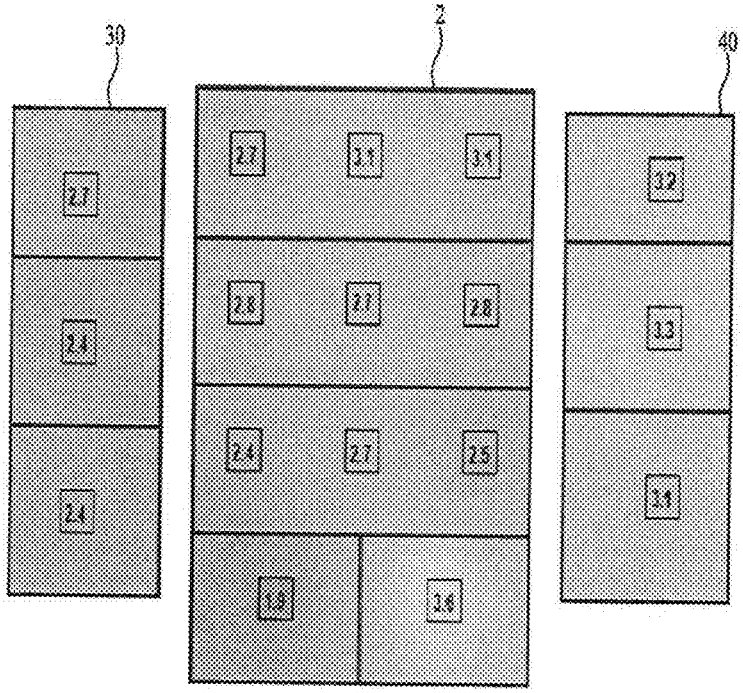
FIG. 12 is a diagram illustrating temperature distribution in accordance with the present disclosure.

The related art, in other words, a multi-duct only including a first upper outlet hole, a middle outlet hole, a first lower outlet hole, a second upper outlet hole, a second middle outlet hole and a second lower outlet hole, may have the temperature distribution shown in FIG. 11. The conventional multi-duct fails to have the characteristics of the illustrated embodiment mentioned above. In state where the inner door 40 includes the storage space, the lower end of the inner door 40 may have a temperature of 5.2° C. Accordingly, the foods stored in the lower end portion of the inner door 40 may be exposed to a higher temperature than the foods stored in the other portions and have a relatively short storage period.

However, in a state where the inner door 40 includes the storage space, the lower end of the inner door 40 may have a lowered temperature of 3.2° C. The temperature of 3.2° C. may be as low as the temperature of the other portions in the storage compartment 2.

In the illustrated embodiments of the present disclosure, the velocity of the air supplied to the lower end of the inner door 40 may be raised so that sufficient cold air may be supplied to the lower end of the inner door 40 to chill the storage space provided in the lower end of the inner door 40. Moreover, in a state where the ice-maker 35 is provided in the first door 30, the amount of the cold air supplied to the ice-maker may be reduced and the amount of the cold air supplied to the inner door 40 may be increased, so as to lower the temperature of the storage space arranged in the inner door 40 sufficiently. Also, the plurality of the outlet holes may be provided in the illustrated embodiments of the present disclosure and the uniformly constant temperature may be distributed in the storage compartment.

A filter module may be installed in the multi-duct in the present disclosure to purify the internal air of the storage compartment. In this instance, the filter module may be provided in an upper portion of the multi-duct cover and in a center of the first upper outlet hole and the second upper outlet hole.

The filter module may include a filter box. The filter box may include some bacteriostatic filters, antiallergenic filters and deodorizing filters.

The antiallergenic filter may include one or more of a group including charcoal, silver (Au), allercatcher fiber, Co-Phthalocyanine and Fe-Phthalocyanine. Charcoal may be Au-supported T-SCOB, T-E for selectively absorbing Ethylene and T-TS adhesive charcoal for selectively absorbing aldehyde that is usually generated in Doenjang (Korean fermented soybean paste) or fermented foods. Such the antiallergenic filter has a function of removing allergy-inducing factors from the storage compartment. The deodorizing filter may remove a bad smell from the storage compartment.

A refrigerator may include: a cabinet comprising a storage compartment provided therein; a first door opening and close a predetermined side of the storage compartment; an inner door opening and closing the other side of the storage compartment and comprising a storage space for storing foods; an outer door opening and closing an opening that is provided in the inner door; and a multi-duct provided in an inner wall of the storage compartment and comprising: a first duct comprising a first upper outlet hole, a first middle outlet hole and a first lower outlet hole for exhausting cold air toward the first door of the storage compartment; and a second duct comprising a second upper outlet hole, a second middle outlet hole and a second lower outlet hole for exhausting cold air toward the inner door of the storage compartment. An inlet hole for sucking cold air to the first duct may be smaller than an inlet hole for sucking cold air to the second duct. The cold air supplied from the first duct may be smaller than the cold air supplied from the second duct to the storage compartment.

In case an ice-maker for providing a user with ice is provided in the first door and the storage compartment is a refrigerator compartment, less cold air may be supplied to the ice-maker to prevent a portion of the storage compartment near the ice-maker from having a lower temperature than a preset temperature for the storage compartment. A rear surface of the storage space may be blocked by a cover in which a penetration hole is formed. The storage space may be shut off to a preset degree from the storage compartment and some air can flow through the penetration hole. An upper end may be wider than a lower end of the first duct.

A first outlet hole may be formed between the first upper outlet hole and the first middle outlet hole in the first duct. The first outlet hole may be arranged closer to a left wall of the storage compartment than the first upper outlet hole and the first middle outlet hole.

A first projected piece may be provided in one end of the first outlet hole and may guide the cold air exhausted via the first outlet hole. The first duct may include a first guide groove for guiding air toward the first outlet hole. Accordingly, a path for exhausting cold air via the first outlet hole may be secured.

A second outlet hole may be formed between the second upper outlet hole and the second middle outlet hole in the second duct. The second outlet hole may be arranged closer to a right wall of the storage compartment than the second upper outlet hole and the second middle outlet hole.

A second projected piece may be provided in one end of the second outlet hole and guides the cold air exhausted via the second outlet hole. The second duct may comprise a second guide groove for guiding air toward the second outlet hole. Accordingly, a path for exhausting cold air via the second outlet hole may be secured.

The first duct may comprise a projection for reducing the amount of the cold air exhausted via the first upper outlet. The cold air exhausted toward the ice-maker may be reduced.

The width of the projection may get broader and broader from a lower end toward an upper end. An upper end of the projection may be in contact with the second upper outlet hole. Accordingly, the velocity of the air exhausted via the second upper outlet hole may be reduced.

The second duct may comprise a guide portion for guiding cold air toward the second lower outlet hole. The guide portion may comprise an upper surface and a lower surface, and a distance between the upper surface and the lower surface may get smaller as getting closer to the second lower outlet hole. Accordingly, the air flow may be guided.

An extension that may be extended backward from one end of the second lower outlet hole may be formed in one end of the guide portion, and one end of the extension may be rounded. Accordingly, the velocity of the air exhausted via the second lower outlet hole may be prevented from decreasing because of air resistance.

The extension may be arranged closer to a right wall of the storage compartment than the other end of the guide portion.

A distance between the upper surface and the lower surface in the other end of the guide portion may be farther than a distance between them in a longitudinal direction of the second lower outlet hole. The other end of the guide portion may be extended closer to a center of the multi-duct than the second lower outlet hole. Accordingly, a path for guiding the internal air of the second duct toward the guide portion may be secured.

An upper surface of the guide portion may be adjacent to an upper portion of the second lower outlet hole and stepped downward. Accordingly, the air sucked into the guide portion may not flow upward over the second lower outlet hole.

The guide portion may get thicker in a back-and-forth direction as getting closer to a right wall of the storage compartment. The surface of the multi-duct exposed to the storage compartment may be inclined downward from a center to right and left sides.

The refrigerator may further comprise a fan provided in a lower portion of the multi-duct. The fan may blow air upward to upper portions of the first and second ducts.

According to the embodiments of the present disclosure, even when the auxiliary storage space having the ice-maker and the cover is provided in the door, the uniformly constant temperature may be distributed in the refrigerator. Accordingly, the possibility of food spoilage may be varied according to the locations in which the user stores foods and the storage period of the foods may be maintained without drastic change. Furthermore, a relatively less amount of cold air may be supplied toward the ice-maker and too much chilling for the portion near the ice-maker may be prevented.

Still further, cold air may be supplied to the portion of the door in which the storage space is provided and may be supplied at a high velocity. Accordingly, a difference between the temperature of the storage space and the temperatures of the other locations in the storage compartment may be reduced. Still further, the plurality of the outlet holes may be provided in the multi-duct and the temperature inside the space closed by the storage compartment and the door may be uniformly distributed.

Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage compartment provided therein, wherein the storage compartment is a refrigerator compartment;

a first door to open and close a first side of the storage compartment;

an ice-maker provided in the first door;

an inner door to open and close a second side of the storage compartment and including a storage space for storing foods;

an outer door to open and close an opening that is provided in the inner door; and a multi-duct provided at an inner wall of the storage compartment and including:

a first duct having a first upper outlet hole, a first middle outlet hole and a first lower outlet hole to exhaust cold air toward the first door of the storage compartment; and a second duct having a second upper outlet hole, a second middle outlet hole and a second lower outlet hole to exhaust cold air toward the inner door of the storage compartment, wherein an inlet hole of the first duct is smaller than an inlet hole of the second duct, and wherein the first duct includes a projection for reducing a cross-sectional area of the first duct through which the cold air flows to reduce the amount of the cold air exhausted via the first upper outlet hole, such that a horizontal cross-section of the first duct at a lower end of the projection is larger than a horizontal cross-section of the first duct at an upper end of the projection.

2. The refrigerator of claim 1, further comprising a cover that covers a rear surface of the storage space of the inner door wherein a penetrating hole is formed in the cover.

3. The refrigerator of claim 1, wherein an upper end of the first duct is wider than a lower end of the first duct.

4. The refrigerator of claim 1, wherein a first outlet hole is formed between the first upper outlet hole and the first middle outlet hole in the first duct.

5. The refrigerator of claim 4, wherein the first outlet hole is arranged closer to a first sidewall of the storage compartment than the first upper outlet hole and the first middle outlet hole.

6. The refrigerator of claim 5, wherein a first projected piece is provided at one end of the first outlet hole and guides the cold air exhausted via the first outlet hole.

7. The refrigerator of claim 5, wherein the first duct includes a first guide groove to guide air toward the first outlet hole.

8. The refrigerator of claim 1, wherein a second outlet hole is formed between the second upper outlet hole and the second middle outlet hole in the second duct.

9. The refrigerator of claim 8, wherein the second outlet hole is arranged closer to a second sidewall of the storage compartment than the second upper outlet hole and the second middle outlet hole.

10. The refrigerator of claim 8, wherein a second projected piece is provided at one end of the second outlet hole and guides the cold air exhausted via the second outlet hole.

11. The refrigerator of claim 8, wherein the second duct includes a second guide groove to guide air toward the second outlet hole.

12. The refrigerator of claim 1, wherein a width of the projection increases from a lower end toward an upper end of the projection, the upper end being provided closer to the first upper outlet hole.

13. The refrigerator of claim 1, wherein the second duct includes a guide portion to guide cold air toward the second lower outlet hole, wherein the guide portion includes an upper surface and a lower surface, and a distance between the upper surface and the lower surface decreases from a first end to the guide portion toward a second end of the guide portion, wherein the second end is closer to the second lower outlet hole.

14. The refrigerator of claim 13, wherein an extension that extends backward from a first end of the second lower outlet hole is formed at a first end of the guide portion, and a first end of the extension is rounded.

15. The refrigerator of claim 14, wherein the cabinet includes a first sidewall and a second sidewall, and wherein the extension is arranged closer to the second sidewall of the storage compartment than a second end of the guide portion.

16. The refrigerator of claim 14, wherein a distance between the upper surface and the lower surface at the second end of the guide portion is farther than a distance between the upper surface and the lower surface in a longitudinal direction of the second lower outlet hole.

17. The refrigerator of claim 14, wherein the second end of the guide portion extends closer to a center of the multi-duct than the second lower outlet hole.

18. The refrigerator of claim 14, wherein an upper surface of the guide portion is adjacent to an upper portion of the second lower outlet hole and stepped downward.

19. The refrigerator of claim 13, wherein a thickness of the guide portion increases in a depth direction of the refrigerator when approaching a sidewall of the storage compartment.

20. The refrigerator of claim 1, wherein the inlet hole of the first duct has a width of w1 and the inlet hole of the second duct has a width of w2, wherein w2 is greater than w1, and wherein a distance between the first inlet hole and the second inlet hole is greater than w2.

* * * * *